United States Patent [19]

Richardson

[11] 4,187,674

[45] Feb. 12, 1980

[54] COMBUSTION EQUIPMENT FOR GAS TURBINE ENGINES

[75] Inventor: John P. Richardson, Yokohama, Japan

[73] Assignee: Rolls-Royce Limited, London, England

[21] Appl. No.: 870,593

[22] Filed: Jan. 18, 1978

[30] Foreign Application Priority Data

Jan. 21, 1977 [GB] United Kingdom ..... 2467/77

[51] Int. Cl.[2] ..... F02C 7/22

[52] U.S. Cl. ..... 60/39.36; 60/743; 60/748

[58] Field of Search ..... 60/39.65, 39.71, 39.74 R, 60/39.74 B, 39.36

[56] References Cited

U.S. PATENT DOCUMENTS

| | | | |
|---|---|---|---|
| 2,823,739 | 2/1958 | Michalski | 239/419 |
| 3,310,240 | 3/1967 | Grundman | 239/406 |
| 3,383,855 | 5/1968 | Freeman et al. | 60/39.65 |
| 3,530,667 | 9/1970 | Bryan | 60/39.74 R |
| 3,589,127 | 6/1971 | Kenworthy et al. | 60/39.74 R |
| 3,859,786 | 1/1975 | Azelborn et al. | 60/39.74 R |
| 3,859,787 | 1/1975 | Anderson et al. | 60/39.71 |
| 3,886,728 | 6/1975 | Quinn | 60/39.71 |
| 3,938,324 | 2/1976 | Hammond et al. | 60/39.74 R |
| 4,105,163 | 8/1978 | Davis et al. | 60/39.74 R |

*Primary Examiner*—Robert E. Garrett

*Attorney, Agent, or Firm*—Cushman, Darby & Cushman

[57] ABSTRACT

A potted head combustion chamber is provided with an annular gap between the downstream end of the pot and the combustion chamber itself. Air is supplied radially inwardly through this gap to remove any fuel which adheres to the walls of the pot, and prevents it from reaching the walls of the combustion chamber. Fuel on the combustion chamber walls can cause localized burning of the fuel with a consequent increase in temperature of that part of the combustion chamber wall.

4 Claims, 1 Drawing Figure

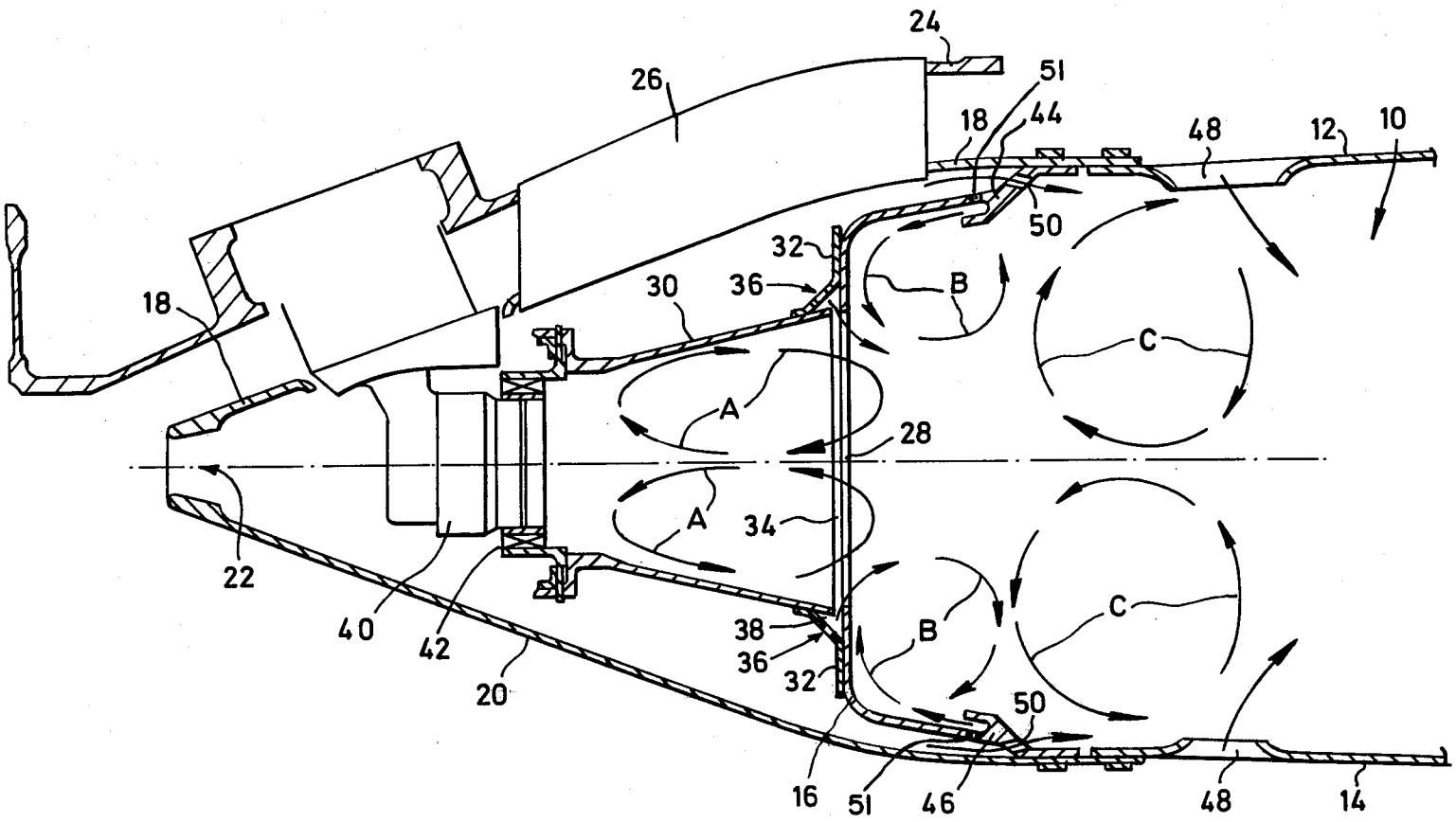
10
12
14
48
48
C
C
51
44
50
50
18
24
B
B
28
46
51
16
32
36
34
38
36
32
A
A
30
26
20
42
40
22
18

COMBUSTION EQUIPMENT FOR GAS TURBINE ENGINES

This invention relates to combustion equipment for gas turbine engines.

A combustion chamber for a gas turbine engine is generally provided with a fast moving gas stream and must provide not only for ignition of fuel in this fast moving gas stream, but also continuation of the combustion process and preferably full combustion of the fuel in a relative short period of time in order to reduce the quantity of pollutants produced.

There is a continuing demand for more power per unit volume of a combustion chamber and per a given mass of fuel, and this can only be achieved by providing more air in the combustion chamber which generally means even higher velocities of air flow.

A recent design of combustion chamber which can cope with higher velocities of air flow is annular in shape with an annular flame tube mounted inside it, the flame tube having a circumferential array of upstream projecting pots or vortex generators at its upstream end. Fuel is introduced into the pots and mixed with enough air to commence ignition, the remaining air necessary for combustion being supplied through perforations in the walls of the flame tube.

The fuel/air mixture in each pot is rich and swirling this rich mixture tends to deposit a film of fuel on the walls of the pot. If the film reaches the flame tube itself, localised burning of this fuel can take place causing excessively high temperatures on portions of the flame tube walls.

It is an object of the present invention to provide combustion equipment for gas turbine engines which will reduce or overcome this problem.

According to the present invention combustion equipment suitable for a gas turbine engine and intended to be located in a stream of compressed air comprises an annular flame tube having a circumferential array of upstream projecting pots or vortex generators at its upstream end, each pot comprising a substantially tubular duct with fuel injection means located adjacent the upstream end thereof, there being provided duct means located adjacent to the downstream end of each pot which duct means is adapted to direct a supply of air substantially radially into the downstream end of each pot whereby to detach any fuel from the downstream end of the wall of the pot.

The duct means may comprise at least a part-circumferential orifice extending around the circumference of adjacent to the downstream end of the pot.

Preferably the duct means comprises a circumferential gap between the downstream end of the pot and the upstream end of the flame tube.

Preferably the supply of air is intended to be directed through the circumferential gap from an annular manifold surrounding the circumferential gap. The annular manifold is preferably adapted to be supplied with air via a plurality of orifices arranged in the wall of the annular manifold.

The invention also comprises a gas turbine engine having combustion equipment as set forth above.

An embodiment of the invention will now be described by way of example only with reference to the accompanying drawing which is a cross-sectional view of part of combustion equipment for a gas turbine engine constructed in accordance with the invention.

The combustion equipment comprises an annular flame tube 10 having an outer annular wall 12 and an inner annular wall 14 which are connected together at their upstream ends by an end plate 16. The walls 12 and 14 each have upstream projecting annular plates 18 and 20 respectively, which together define an annular primary air intake 22 for the flame tube.

The flame tube 10 is mounted within an annular combustion chamber, a portion 24 only of the outer wall of the combustion chamber being shown. The flame tube is supported at its upstream end from the portion 24 by a streamlined strut 26, and at its downstream end by means not shown so as to define annular spaces between the flame tube walls and the combustion chamber walls which annular spaces are intended for the flow of cooling and dilution air.

The end plate 16 is secured to the flame tube walls 12 and 14 by rivets as shown, or it could be suitably bonded, welded or even formed integrally with the flame tube walls. The end plate 16 is provided with a plurality of circumferentially arranged circular holes 28, and mounted on the end plate 16 in line with the holes 28 in an equal number of vortex generators or pots 30. Each pot is in the form of a truncated cone having its larger diameter adjacent to the plate 16, and is secured to the end plate 16 by an annular ring 32 so as to leave a circumferential gap 34 between the downstream end of the pot 30 and the plate 16. The downstream end of each pot has a diameter substantially the same as the diameter of its dajcent hole 28. Circumferential gap 34 may not extend completely around the end of the pot 30 or could consist of a series of part circumferential slots or holes.

The annular rings 32 are each formed with a plurality of upstream facing holes 36, and each ring forms an annular manifold 38 surrounding the gap 34.

At the upstream end of the pot 30 is mounted a fuel injector 40 located by axially extending swirl vanes 42. In the flame tube and located immediately downstream of the end plate 16 is a pair of annular cooling rings 44 and 46, having circumferentially arranged holes 50 and 51 the purposes of which are described later, and the usual dilution holes 48 are provided in the flame tube walls downstream of the cooling rings. The flame tube can be made of laminated material as described and claimed in our co-pending application number 53892/74.

When the gas turbine engine is operating, high pressure air is supplied to the combustion equipment from compressor means, a portion of this air passing as primary air into the air intakes 22 and a further portion into the annular spaces surrounding the flame tube 10. Most of the primary air enters the ends of the pots 30 through the swirl vanes 42 and through the fuel injectors 40 and mixing of the fuel and air takes place in the pots 30. This swirling mass in each pot forms itself into an annular vortex as indicated by the arrows A and there is a tendency for some fuel to be deposited on the internal walls of the pot 30 since the fuel/air ratio is high at this position.

A small proportion of primary air (nominally 3 to 5% of the total airflow into the combustion equipment) passes through the holes 36 into each manifold 38 which surrounds the circumferential gap 34, and then passes substantially radially out of the circumferential gap 28 effectively breaking the fuel deposited on the pot walls 30 away from the downstream edge of the wall.

The mixture then enters the flame tube 10 and forms two further annular vortices indicated by the arrows B, and these vortices are stabilised by the cooling rings 44 and 46 by the air entering through the holes 51. Further air enters the flame tube 10 through the holes 50 in the cooling rings, to create another pair of annular votices indicated by the arrows C.

Ignition of the mixture commences at the upstream end of the flame tube 10 and dilution air is supplied through the holes 48 in known manner to cool the gases before they reach the end of the flame tube.

The air flowing radially through the circumferential gap 34 prevents fuel from reaching the flame tube walls where it could burn in contact with the walls 12 and 14 causing excessively high temperatures on the walls and perhaps subsequent failure of the flame tube. The rate of flow of this air is governed by the size of the holes 36 which have a smaller total cross-sectional area than the gap 34 and it has been found that this rate of flow is quite important. Flows much above the 5% as mentioned previously have a tendency to extinguish the flames, whilst flows much below the 3% tend not to efficiently detach the fuel from the pot walls 30.

The efficient mixing of the fuel and air due to the three vortex effects causes improved combustion efficiency at weak/air ratios, i.e. at lower speeds of the engine.

I claim:

1. Combustion equipment for a gas turbine engine to be located in a stream of compressed air, comprising:

an annular flame tube having an upstream end wall provided with a circumferential array of equispaced generally circular apertures for the admission of liquid fuel and air into said tube, the diameter of each of said apertures being less than the radial dimension of said end wall;

a plurality of upstream-projecting vortex-generating pots, one for each of said apertures arranged adjacent the upstream side thereof and aligned therewith, each of said pots comprising a downstream-diverging generally conical duct;

liquid fuel injection means adjacent the upstream end of each of said pots which, in operation, tends to form a film of fuel on the inner surface of the corresponding one of said ducts; and duct means adjacent the downstream end of each of said pots comprising a substantially circumferential gap between the downstream end of the corresponding one of said pots and said upstream side of the corresponding one of said apertures for directing a supply of the compressed air substantially radially inwardly across said downstream end of the corresponding one of said ducts for detaching therefrom the film of fuel on the inner surface thereof so that the film will be entrained in vortices formed within the upstream end of said flame tube and will not burn on the walls of said tube.

2. Combustion equipment as claimed in claim 1 in which each duct means includes an annular manifold surrounding the corresponding gap for receiving a supply of the compressed air and directing it through said gap.

3. Combustion equipment as claimed in claim 2 wherein the wall of the annular manifold is provided with a plurality of orifices for receiving a supply of the compressed air.

4. Combustion equipment as defined in claim 1 in which the air passing through all of the gaps is in the range of from about 3% to about 5% of the total flow of the airstream supplied to said equipment.

* * * * *